US006945324B2

(12) United States Patent
Weng

(10) Patent No.: US 6,945,324 B2
(45) Date of Patent: Sep. 20, 2005

(54) CONTROLLING METHOD FOR THE DISCHARGE OF COOLANT MEDIUM IN THE HEAT EXCHANGE WIND BOX

(75) Inventor: Kuo-Liang Weng, Taichung Hsien (TW)

(73) Assignee: Cohand Technology Co., Ltd., Taichung Hsien (TW)

( * ) Notice: Subject to any disclaimer, the term of this patent is extended or adjusted under 35 U.S.C. 154(b) by 303 days.

(21) Appl. No.: 10/320,445

(22) Filed: Dec. 17, 2002

(65) Prior Publication Data

US 2004/0112584 A1 Jun. 17, 2004

(51) Int. Cl.[7] ..... F24F 11/00

(52) U.S. Cl. ..... 165/218; 165/219; 165/247; 165/256; 165/260; 165/299; 165/50; 236/49.3; 236/91 F; 236/94; 237/8 R

(58) Field of Search ..... 165/50, 218, 219, 165/220, 221, 247, 256, 260, 299; 236/49.3, 91 F, 94, 8 R; 237/8 R

(56) References Cited

U.S. PATENT DOCUMENTS 3,425,485 A * 2/1969 Newton ..... 165/218
3,685,574 A * 8/1972 Worms ..... 165/221
3,693,704 A * 9/1972 Newton ..... 165/221
3,906,742 A * 9/1975 Newton ..... 62/332
4,718,478 A * 1/1988 Huber ..... 165/220
5,443,207 A * 8/1995 Genga ..... 237/8 R
5,466,995 A * 11/1995 Genga ..... 318/3
5,622,221 A * 4/1997 Genga et al. ..... 165/208
6,112,545 A * 9/2000 Stethem ..... 62/434

FOREIGN PATENT DOCUMENTS

GB 2245967 A * 1/1992 ..... F24F/11/00

* cited by examiner

*Primary Examiner*—John K. Ford
(74) *Attorney, Agent, or Firm*—Rosenberg, Klein & Lee

(57) ABSTRACT

The invention relates to a controlling method of the discharge of coolant medium, and more particularly to a controlling method of the discharge of coolant medium in the heat exchange wind box. By mainly controlling the discharge of coolant medium in the heat exchange wind box, it is able to directly control the volume of discharged coolant medium that supplies the circulation need of the heat exchange tube according to the variations of the target volumes of environmental heat energy in the freezing and air-conditioning area. Therefore, it increases the operation efficiency of the freezing and air-conditioning equipment and achieves the heat balance stability of the freezing and air-conditioning area. Furthermore, by saving the circulated volume of the coolant medium, it achieves the energy saving objective.

2 Claims, 13 Drawing Sheets

CONTROLLING METHOD FOR THE DISCHARGE OF COOLANT MEDIUM IN THE HEAT EXCHANGE WIND BOX

BACKGROUND OF THE INVENTION (1) Field of the Invention

The invention relates to a controlling method of the discharge of coolant medium, and more particularly to a controlling method of the discharge of coolant medium in the heat exchange wind box. By mainly controlling the discharge of coolant medium in the heat exchange wind box, it is able to directly control the volume of discharged coolant medium that supplies the circulation need of the heat exchange tube according to the variations of the target volumes of environmental heat energy in the freezing and air-conditioning area. Therefore, it increases the operation efficiency of the freezing and air-conditioning equipment and achieves the heat balance stability of the freezing and air-conditioning area. Furthermore, by saving the circulated volume of the coolant medium, it achieves the energy saving objective.

(2) Description of the Prior Art

The air-conditioning room layout of a prior centralized freezing and air conditioning system (as shown in FIG. 1) mainly comprises a deliver pump 10 to supply the deliver power of the coolant medium to the entire system and allows the coolant medium to be transferred to individual coolant medium input pipes 171, 172, 173 through a main deliver pipe 101. The deliver pump 10 further comprises a controller 102 and a pressure detector 103, and it utilizes the pressure detector 103 to detect the output pressure of the coolant medium which is used as the basis for the controller 102 to control the revolving speed of deliver pump 10 and the total discharged volume of coolant medium in the entire system. In addition, the deliver pump 10 in the freezing and air-conditioning system sends out coolant medium which is delivered by the way of main deliver pipe 101 to the coolant medium input pipes 171, 172, 173, each corresponding to a wind box 131, 132, 133, respectively, which supplies freezing and conditioning air to a freezing and air-conditioning area D11, D12, D13, respectively. Each of the freezing and air-conditioning area D11, D12, D13 comprises a wind box 131, 132, 133 (wherein each wind box further comprises a heat exchange tube 1312, 1322, 1332 and a air generator 1311, 1321, 1331), a coolant medium input pipes 171, 172, 173, a coolant medium retune pipe 161, 162, 163, a controller 111, 112, 113, a temperature detector 141, 142, 143 (which is formed on the control panel 151, 152, 153), a control valve 121, 122, 123 (usually an electric water valve or a coolant electric-magnetic valve), and a control panel 151, 152, 153. The controller 111, 112, 113 controls the operation of the air generator 1311, 1321, 1331 and the ON-OFF switching operations of the control valve 121, 122, 123 according to the environmental temperature values TA1 detected by the temperature detector 141, 142, 143 and the direction of the control panel 151, 152, 153. However, the biggest disadvantage of the prior art is that, by the use of the ON-OFF switch, the control valve 121, 122, 123 can only control the supply volume of the coolant medium at two different levels, i.e., switching ON when in need of cool (hot) air and switching OFF when not in need of cool (hot) air. The supplied volume of the coolant medium is always sent out at constant volume according to the total discharge volume (i.e., the maximum discharge volume), which disregards the actual need of the freezing and air-conditioning area and only depends on the wind discharge adjustment of the control valve 121, 122, 123 or the air generator 1311, 1321, 1331 to maintain the constant temperature requirement of the freezing and air-conditioning area. As result, the environmental temperature of the freezing and air-conditioning area fluctuates too frequently to provide a comfortable freezing and air-conditioning environment and causes excessive waste of energy. Therefore, someone in the industry has proposed a ratio-type control valve to replace the prior two-level control valve. However, although the ratio-type control valve is able to control different levels of discharge volumes, in practical use it has the following disadvantages:

1. Different levels of a building require different deliver pressures for the coolant medium, but the control valve itself can only control its openness and lacks power to push the flow of coolant medium. The coolant medium only depends on its source for delivering, the coolant medium is delivered according to the maximum deliver pressure required by each individual levels of the system, which causes energy waste due to excessive supply.
2. Excessive deliver pressure is also one of the main contributors that cause the ease of control breakdown.
3. Another disadvantage of utilizing control valve is because the control is complex enough to cause high defect rate and is hard for maintenance and repair. Whenever it breakdowns, it has to be locked on the full-open position and looses its energy saving function completely. Therefore, it has no economic value and relatively costs more.

In response to the above disadvantages, the present invention utilizes an adjustable-discharge pump to directly control the discharge volume of the coolant medium in the heat exchange tube of each heat exchange wind box according to the variations of target environmental heat energy values of the freezing and air-conditioning area. Therefore, it is able to adjust the supplied volumes of the coolant medium discharge needed by the circulation of the heat exchange tube according to the variations of the target environmental heat energy values of the freezing and air-conditioning area to achieve the objectives of saving energy, increasing operation efficiency, and solving the disadvantages of the prior art.

SUMMARY OF THE INVENTION

The objective of the present invention is to provide a controlling method of the discharge of coolant medium in the heat exchange wind box. By using this controlling method to control the discharge volume of the coolant medium in the heat exchange wind box, it is able to adjust the supplied volumes of the coolant medium discharge needed by the circulation of the heat exchange tube according to the variations of the target environmental heat energy values of the freezing and air-conditioning area. Therefore, it increases the operation efficiency of the freezing and air-conditioning equipment and achieves the objective of energy saving.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a controlling method of the discharge of coolant medium in the heat exchange wind box. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
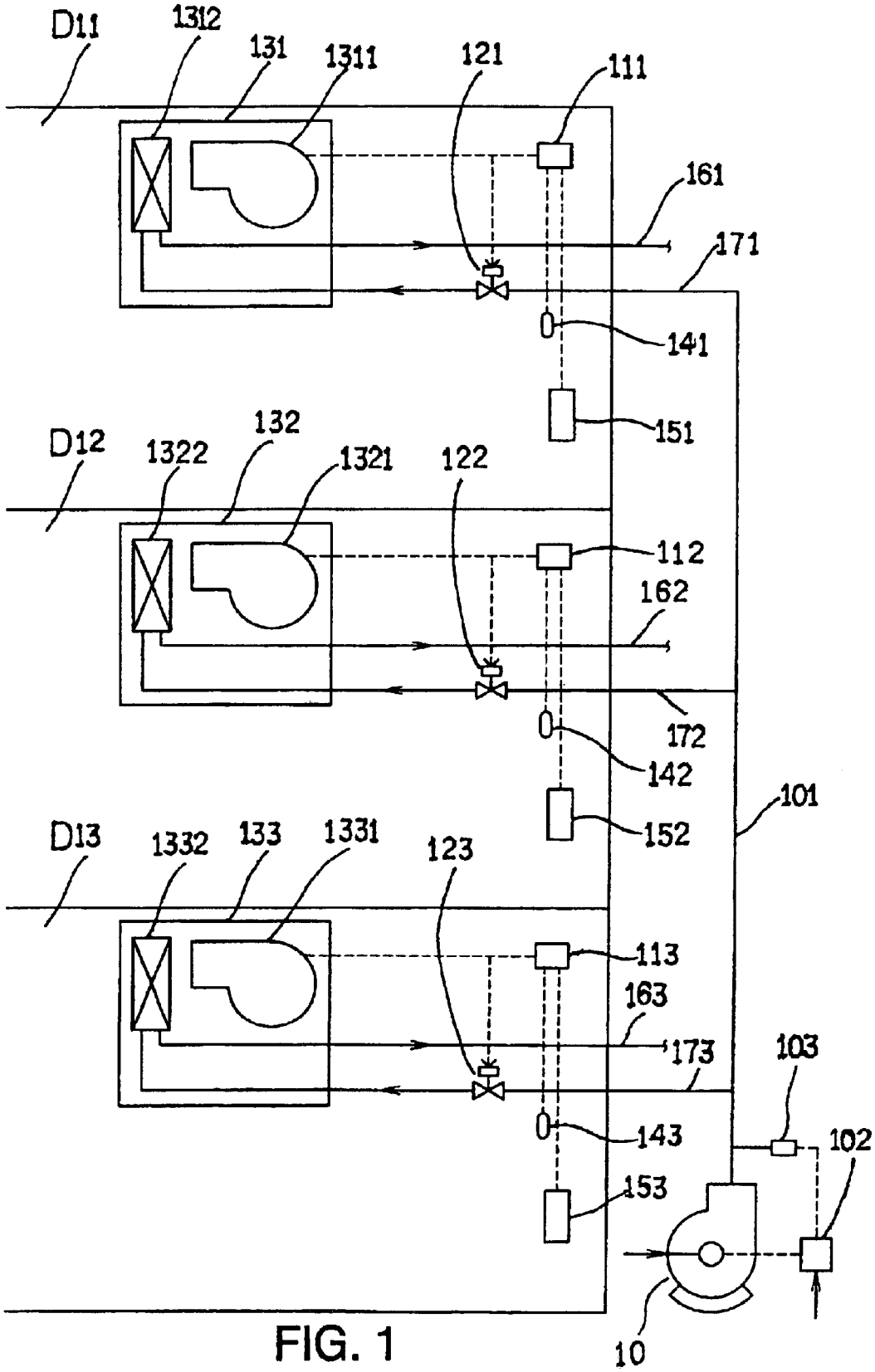
FIG. 1 PRIOR ART
FIG. 1 is a schematic view of a prior freezing and air-conditioning system.
Figure 2:
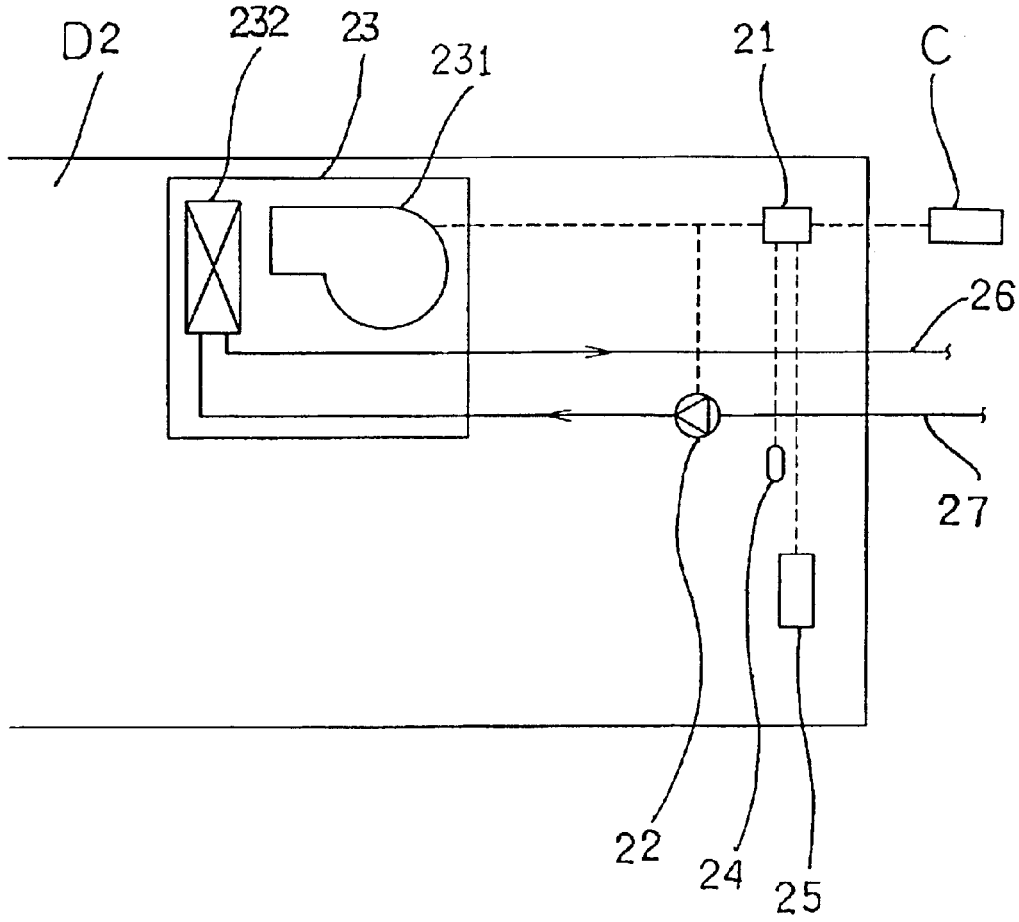
FIG. 2 is a schematic system view of a first preferred embodiment in accordance with the present invention.
Figure 3:
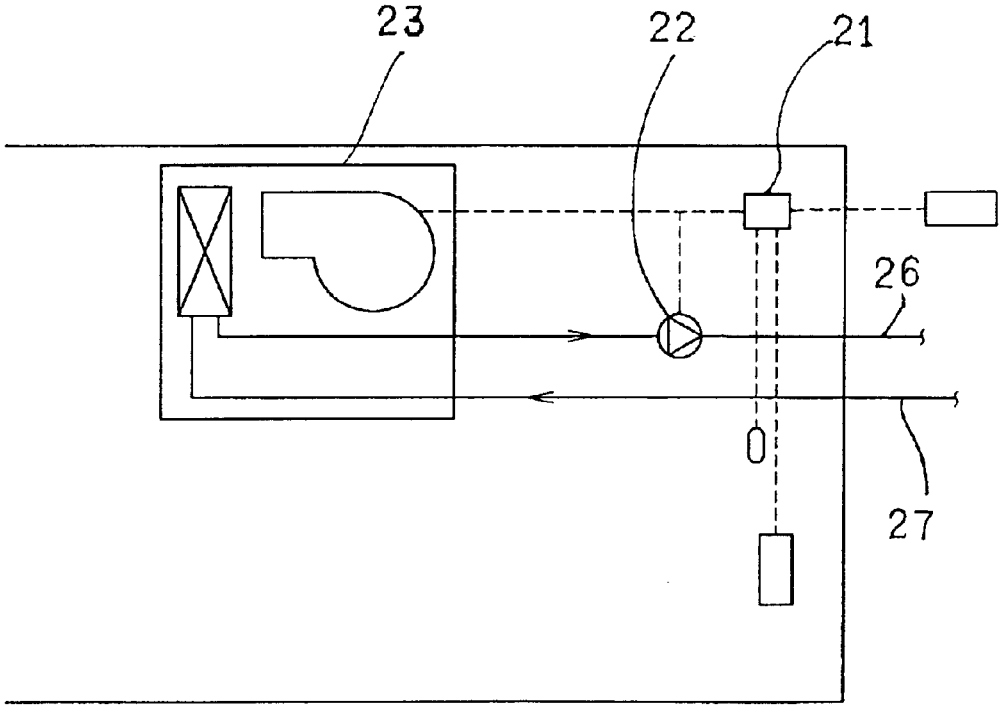
FIG. 3 is a schematic system view of a second preferred embodiment in accordance with the present invention.

First, please refer to FIG. 2, a schematic structure view of a preferred embodiment in accordance with the present invention of a centralized freezing and air-conditioning system. In a freezing and air-conditioning area D2, it mainly comprises a heat exchange wind box 23 (which further comprises at least one heat exchange tube 232 and an air generator 231) that is connected to a coolant medium input pipe 27, a coolant medium return pipe 26, and a controller 21. The controller 21 is connected to a detector 24 (located on an optimal detecting position in the freezing and air-conditioning area) and a control panel 25, wherein its main characteristic is that an adjustable-discharge pump 22 is formed on a coolant medium input pipe 27 (or the adjustable-discharge pump 22 can also be formed on the coolant medium return pipe 26, as shown in FIG. 3). Since the adjustable-discharge pump 22 is controlled by the signals of a controller 21, and after comparing the detected target environmental heat energy value TA by a detector 24 with the set heat energy value TAS, the controller 21 controls the operation of an air generator 231 and the discharge volume of the adjustable-discharge pump 22 according the comparison result (wherein the heat energy means the combined index of environmental temperature, humidity, and radiation). The controller 21 is able to transfer the signals of related values to a central control unit C through cable or the wireless method.

Figure 4:
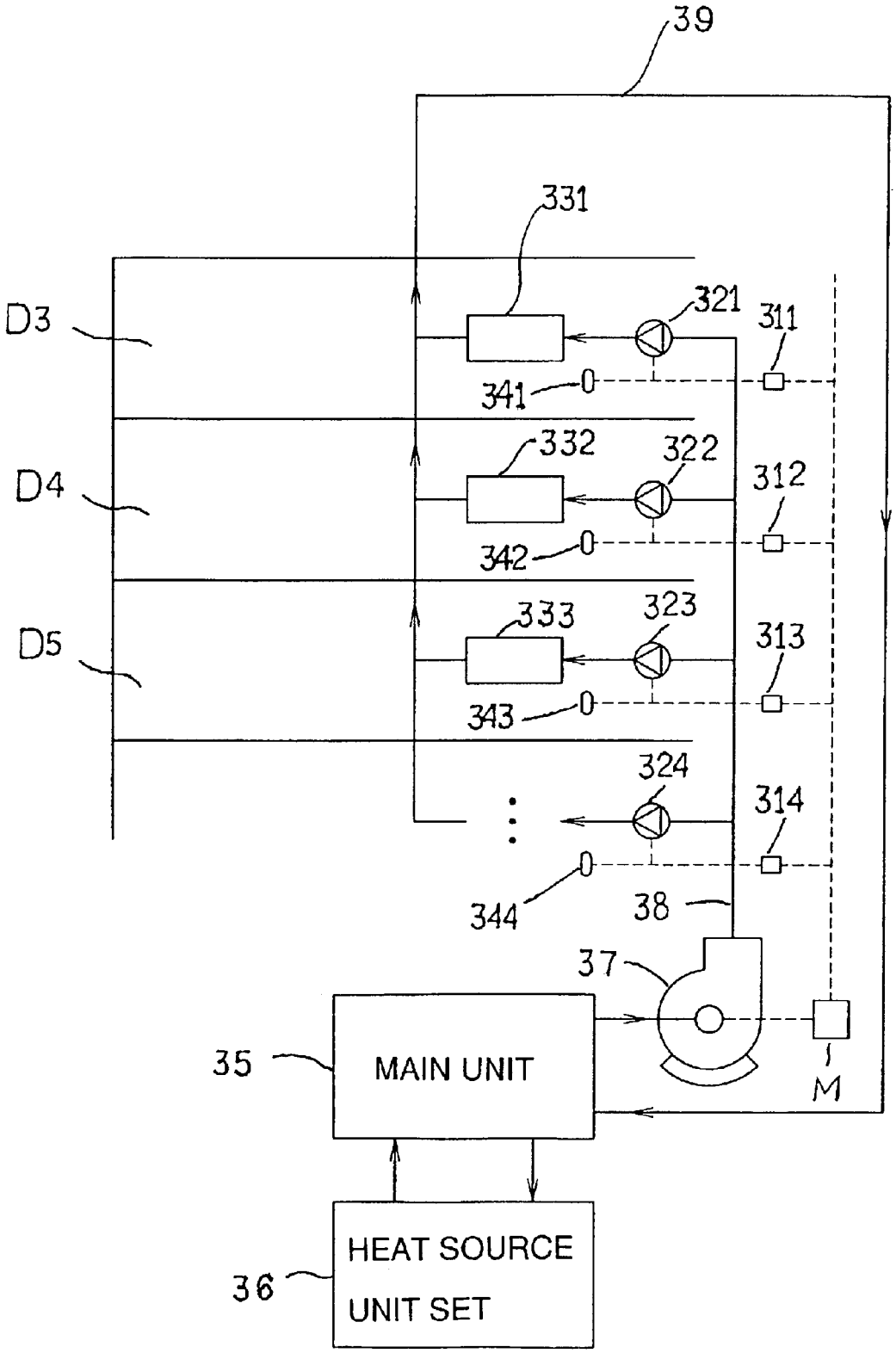
FIG. 4 is a schematic system view of a third supporting frame in accordance with the present invention.

Please refer to FIG. 4, a schematic structure view of a preferred embodiment in accordance with the invention applied to a multi-unit system. The freezing and air-conditioning system comprises plural heat exchange wind boxes 331, 332, 333 . . . which correspond to plural freezing and air-conditioning areas D3, D4, D5 . . . , respectively, and supply the needed exchange volume of heat energy. Each of the heat exchange wind box 331, 332, 333 . . . , besides being positioned as the heat exchange tube and air generator in FIG. 2 (omitted in FIG. 4), comprises an adjustable-discharge pump 321, 322, 323, 324 . . . and a controller 311, 312, 313, 314 . . . on the coolant medium input pipe 38 (or coolant medium return pipe 39). According to the comparison result between the target environmental heat energy value TA detected by each set of controller 341, 342, 343, 344 . . . and the set heat energy value TAS, the controller 311, 312, 313, 314 . . . control the corresponding adjustable-discharge pump 321, 322, 323, 324 . . . , wherein its operation method is completely identical to the previous two embodiments. Within the entire system, a deliver pump 37 supplements the deliver power of the coolant medium (wherein each individual adjustable-discharge pump 321, 322, 323 . . . provides deliver power as well). The main function of the deliver pump 37 is to provide the power needed to supplement the pressure loss in the main deliver pipe, according to the instruction of the main controller M. After converging the inquiry signals transferred by each individual controller 311, 312 . . . , the main controller M controls the operation of the deliver pump 37, while the main unit 35 (usually a main ice water unit) utilizes the heat source of a heat source unit 36 to provide the coolant medium needed by the freezing and air-condition system.

Figure 5:
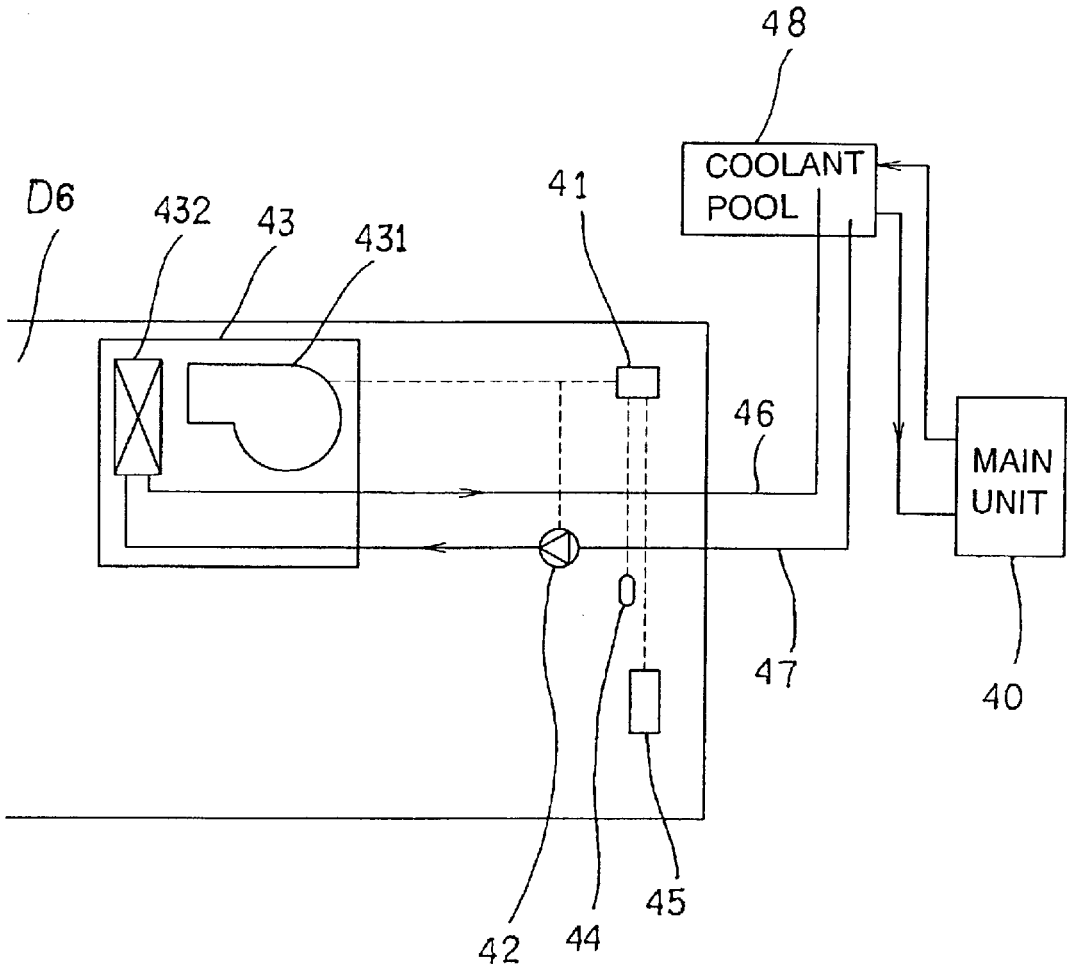
FIG. 5 is a schematic system view of a fourth preferred embodiment in use in accordance with the present invention.

Please refer to FIG. 5, a schematic structure view of a preferred embodiment in accordance with the invention applied to a direct expanding freezing and air-conditioning system. It mainly comprises some basic elements, e.g., a main unit 40 (i.e., the condenser set), a coolant pool 48 (providing low-temperature liquid coolant), a heat exchange wind box 43 (this wind box serves as an evaporator and comprises at least one heat exchange tube 432, and an air generator 341), a coolant discharge controller 41, and a control panel 45. An adjustable-discharge pump 42 is formed on the coolant medium input pipe 47 (or on the coolant medium return pipe 46) that utilizes a detector 44 to detect the target environmental heat energy value TA of the freezing and air-conditioning area to be compared with the set heat energy value TAS. A controller 41 controls the operation of an air generator 431 and the discharge volume of the adjustable-discharge pump 42 according to the comparison result.

Figure 6:
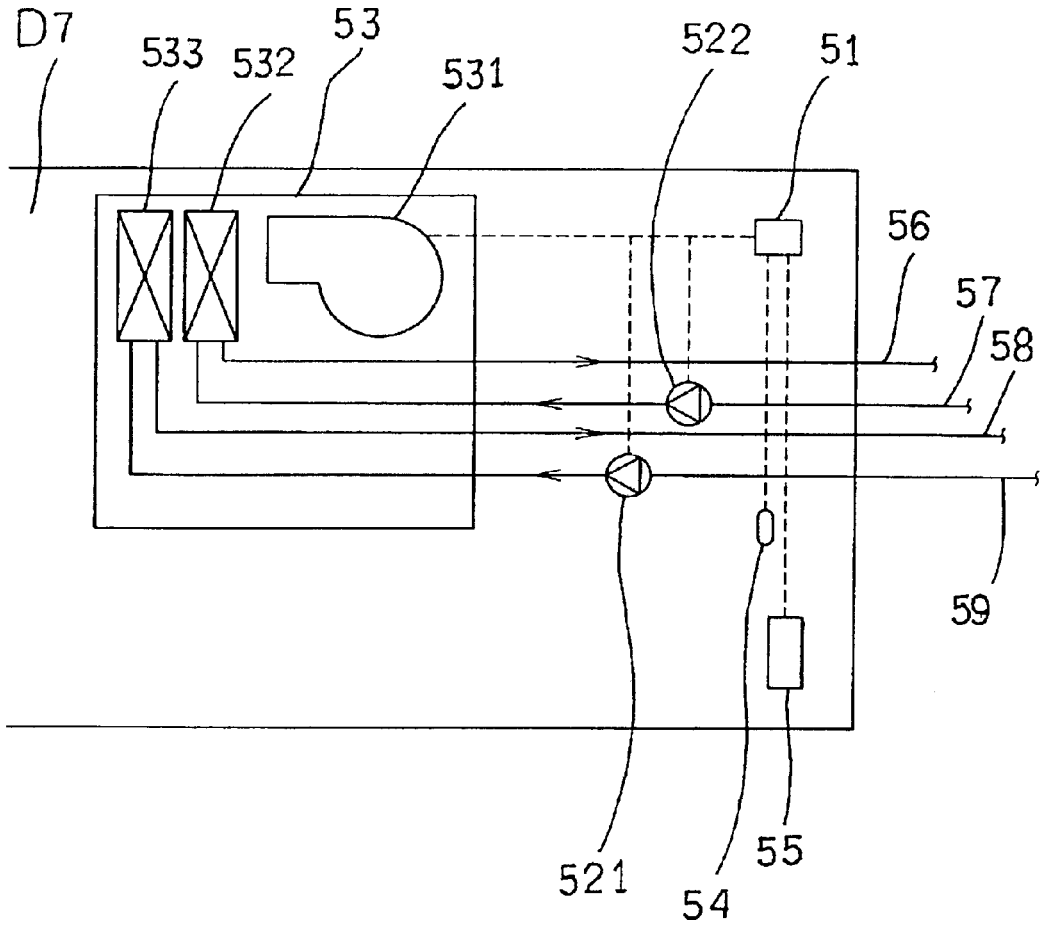
FIG. 6 is a schematic system view of a fifth preferred embodiment in use in accordance with the present invention.

Please refer to FIG. 6, a schematic structure view of a preferred embodiment in accordance with the invention, wherein an freezing and air-conditioning area D7 comprises a heat exchange wind box 53 that further comprises two heat exchange tubes 532, 533. Therefore, the heat exchange wind box 53 comprises a air generator 531, two heat exchange tubes 532, 533, wherein each of the heat exchange tube 532 (533) corresponds to an independent coolant medium input pipe 57 (59), a coolant medium return pipe 56 (58). One of the heat exchange tube 532 (or 533) serves as the low-temperature source to supply cool air to the freezing and air-conditioning area D7, while another heat exchange tube 533 (or 532) serves as a high-temperature source to supply hot air to the freezing and air-conditioning area D7. An adjustable-discharge pump 522, 521 is formed on each individual coolant medium input pipe 57, 59 (or coolant medium return pipe 56, 58) and is controlled by a controller 51. The controller 51 is connected to an air generator 531, a detector 54, and a control pant 55. After comparing the target environmental heat energy value TA detected by the detector 54 with the set heat energy values TAS, the controller 51 controls the operation of the air generator 531 and the discharge volume of the adjustable-discharge pump 521 (522) according the comparison result.

The steps of the controlling method of the preferred embodiment described above:

A. Utilizes the detector to detect the target environmental heat energy value of the freezing and air-conditioning area, TA, and inputs the value into the controller.

Figure 7:
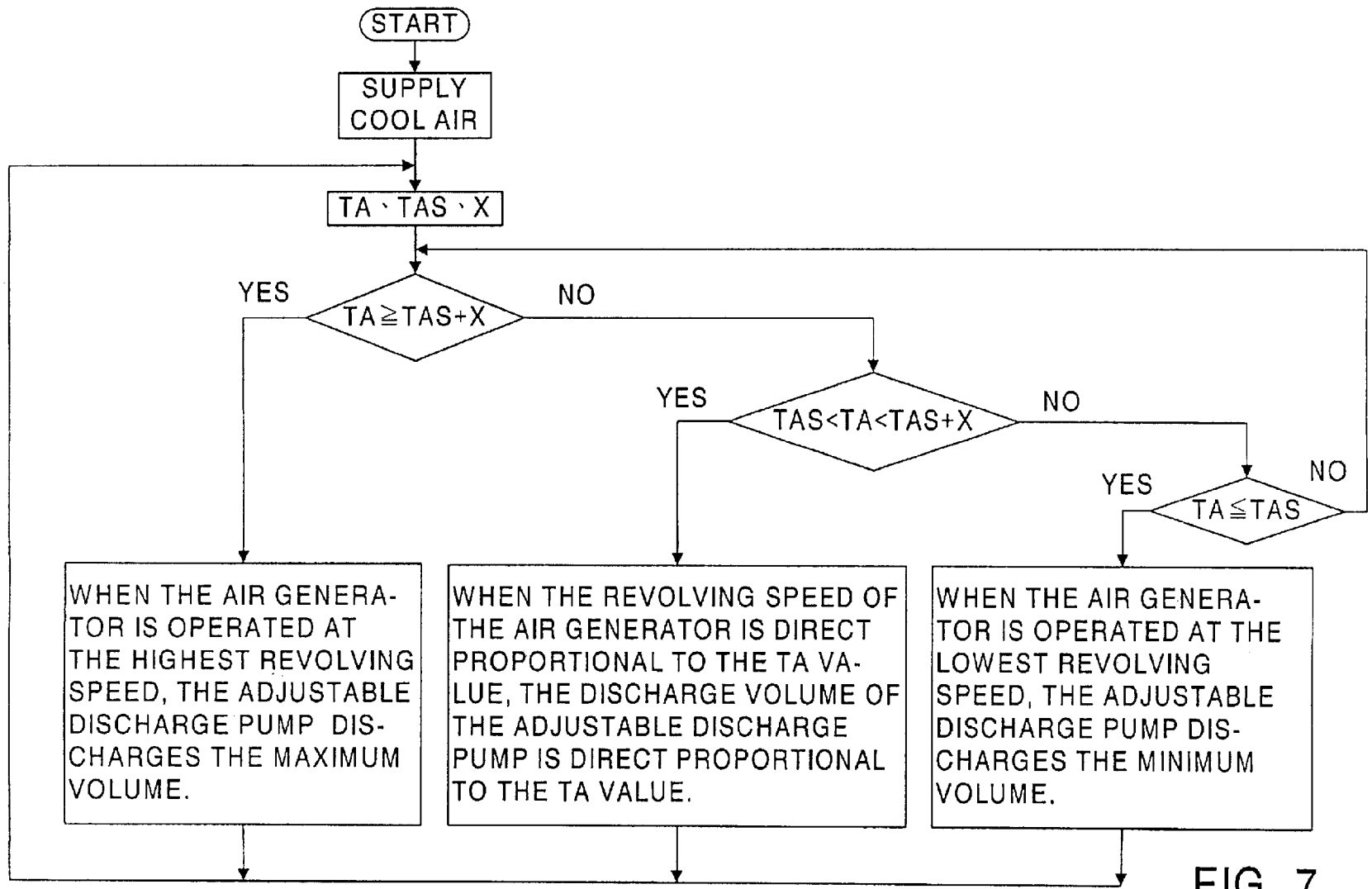
FIG. 7 is a first process flowchart of a preferred controlling method in use in accordance with the present invention.
Figure 8:
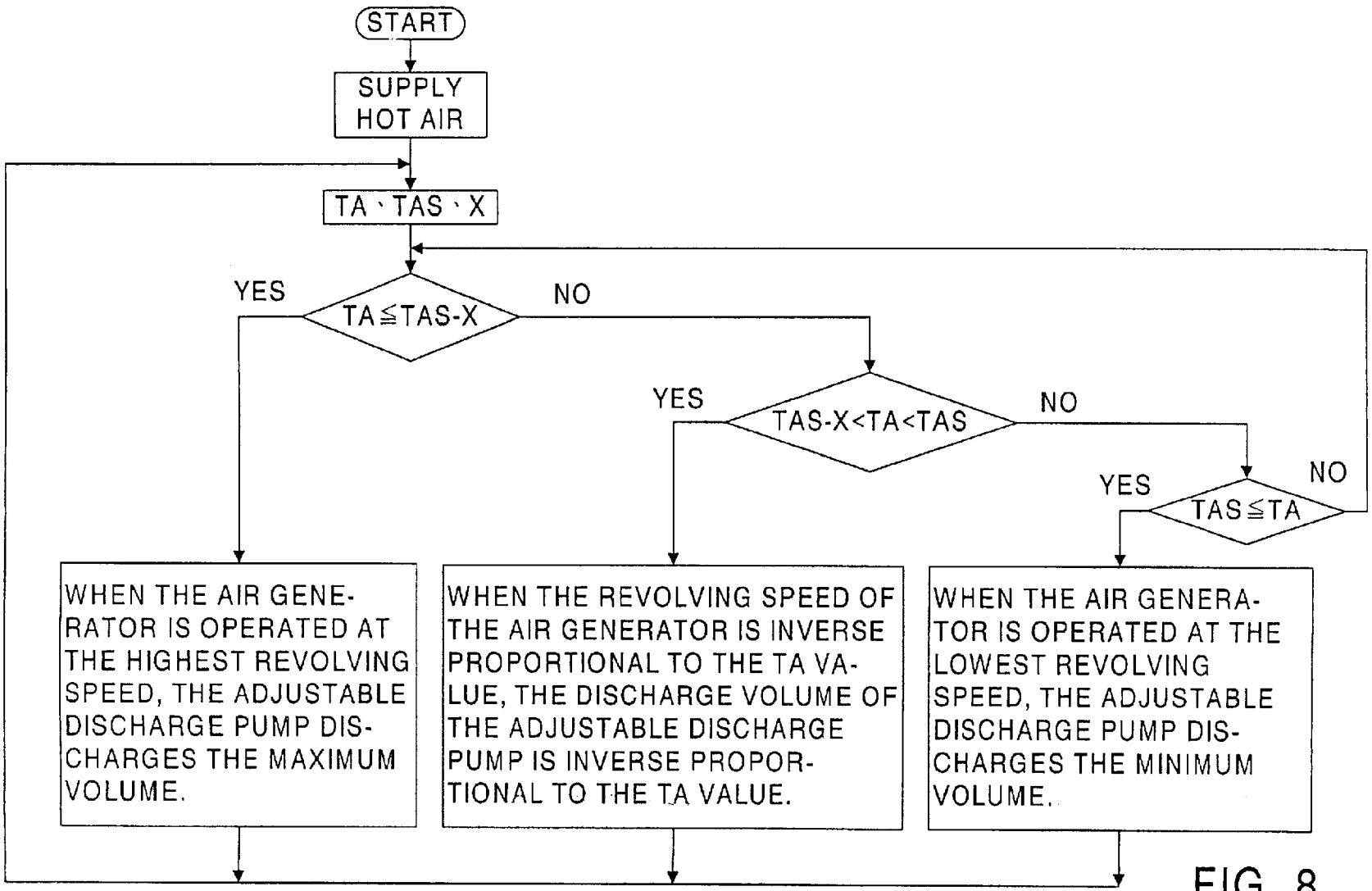
FIG. 8 is a second process flowchart of a preferred controlling method in use in accordance with the present invention.

B. According to the comparison result between the target environmental heat energy value TA and the set heal energy value TAS and the corresponding signals generated by the set mode, the controller controls the revolving speed of the fan motor and the discharge volume of the adjustable-discharge pump at the same time, and its procedures include:

1. When supplying cool air (as shown in FIG. 7):
   (1) When TA≧TAS+X (X is the set difference), the revolving speed of the air generator and the discharge volume of the adjustable-discharge pump are operated at maximum values, i.e., the air generator is operated at its highest revolving speed while the adjustable-discharge pump discharges the largest volume.
   (2) When TAS<TA<TAS+X, the revolving speed of the air generator and the discharge volume of the adjustable-discharge pump are direct proportional to the TA value.
   (3) When TA≦TAS, the revolving speed of the air generator and the discharge volume of the adjustable-discharge pump are operated at minimum values.
2. When supplying hot air (as shown in FIG. 8):
   (1) When TA≧TAS−X, the revolving speed of the air generator and the discharge volume of the adjustable-discharge pump are operated at maximum values, i.e., the air generator is operated at its highest revolving speed, while the adjustable-discharge pump discharges the largest volume.
   (2) When TAS−X<TA<TAS, the revolving speed of the air generator and the discharge volume of the adjustable-discharge pump are inverse proportional to the TA value.
   (3) When TAS≦TA, the revolving speed of the air generator and the discharge volume of the adjustable-discharge pump are operated at minimum values.

Figure 9:
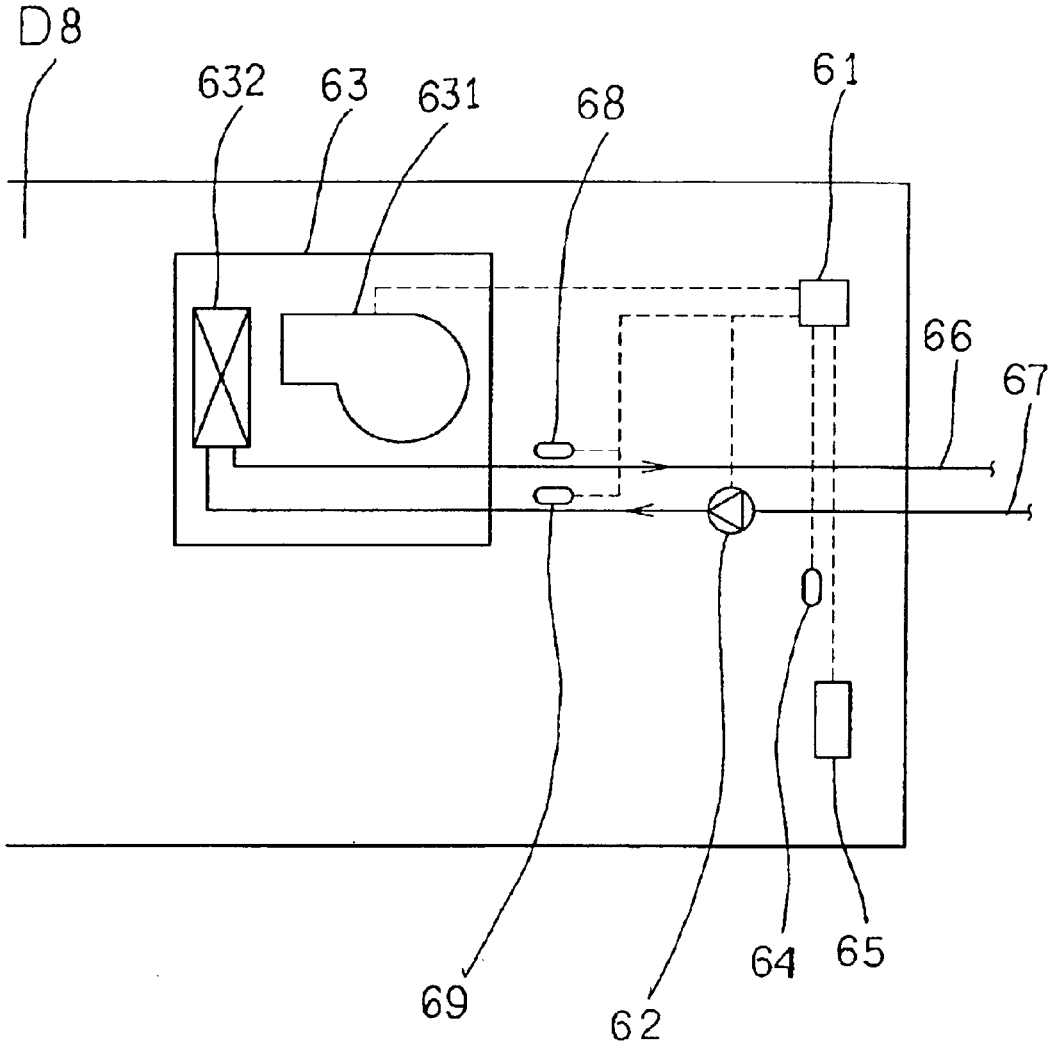
FIG. 9 is a schematic system view of a sixth preferred embodiment in use in accordance with the present invention.
Figure 10A:
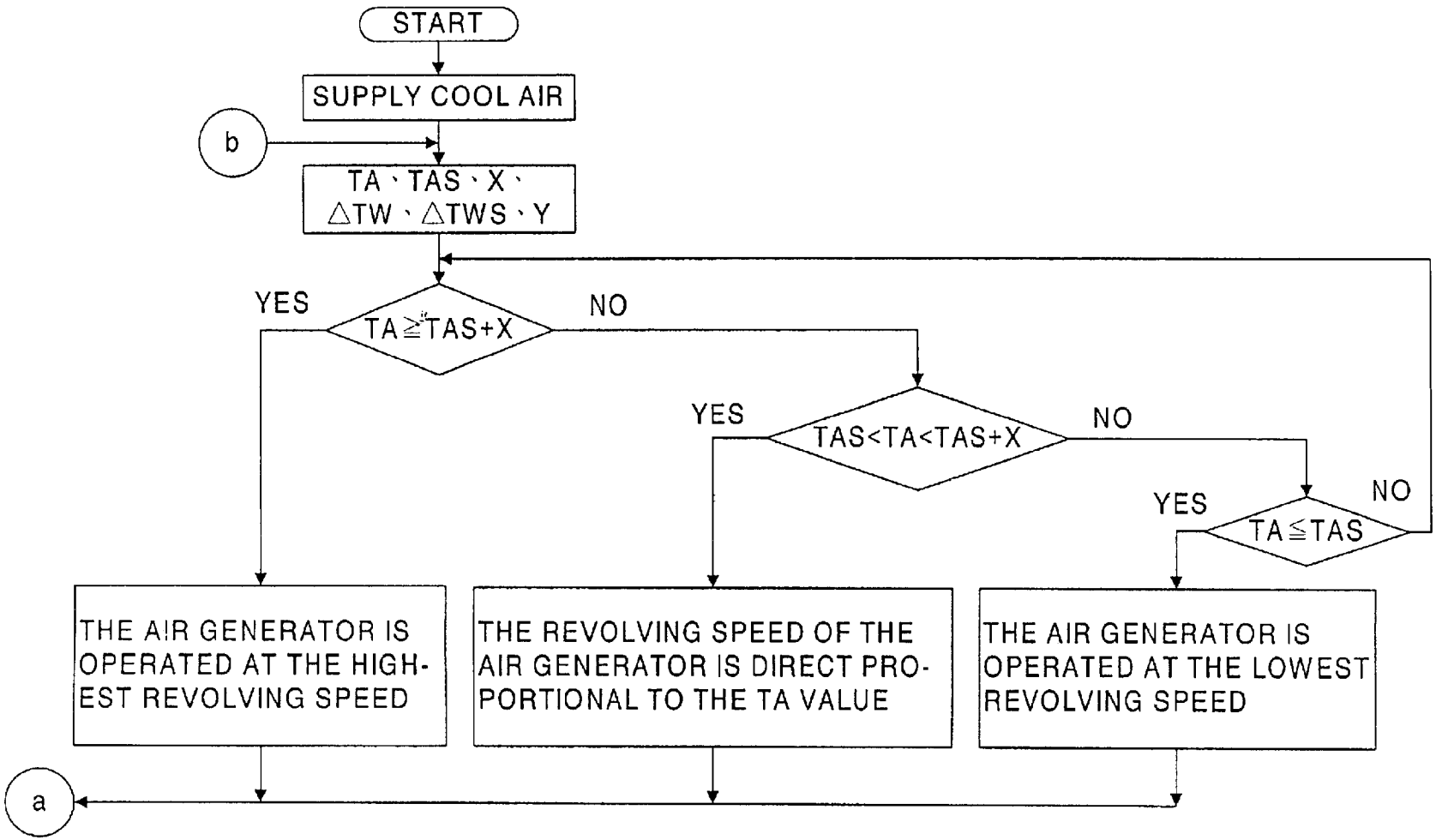
FIG. 10A and FIG. 10B are the first process flowchart of a preferred controlling method in use in accordance with the present invention.
Figure 10B:
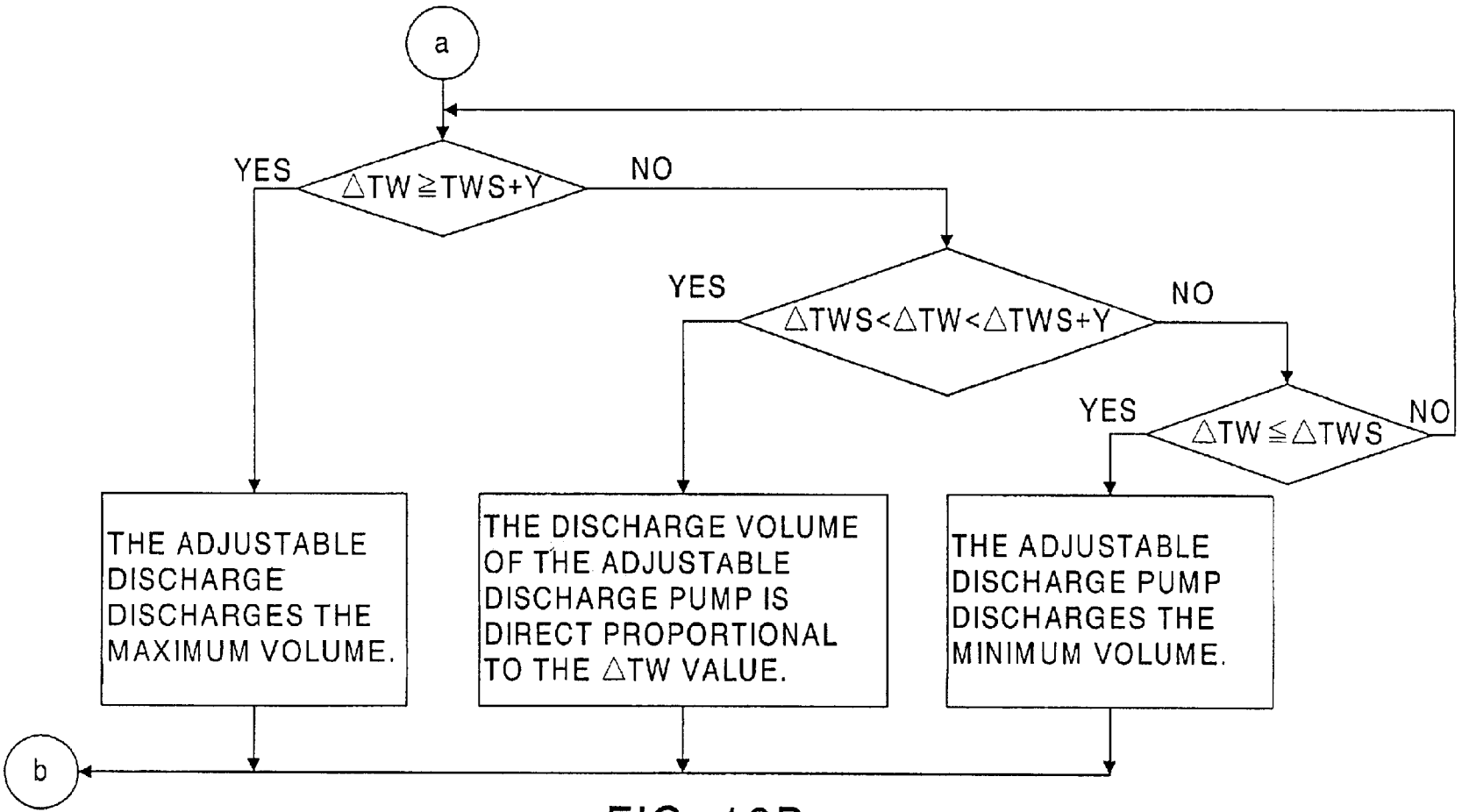

In addition, in order to more precisely control the revolving speed of the air generator and the discharge volume of the adjustable-discharge pump to meet the energy saving effect, as shown in the FIG. 9 of the preferred embodiment in accordance with the present invention, the freezing and air-conditioning system comprises a heat exchange wind box 63 (including a heat exchange tube 632 and an air generator 631), a controller 61, a detector 64 used to detect the target environmental heat energy value TA of the freezing and air-conditioning area D8, and a control panel 65. An adjustable-discharge pump 62 is formed on a coolant medium input pipe 67 (or a coolant medium return pipe 66), wherein each of the coolant medium input pipe 67 and the coolant medium return pipe 66 comprises a detector 69, 68. The detector 69 is used to detect the input coolant medium temperature Tmi, while the detector 68 is used to detect the coolant medium temperature Tmo. According to the two detected values, Tmi and Tmo, it is able to calculate their difference ΔTW (i.e., ΔTW=Tmo−Tmi), wherein the set mode controls the fan motor and the adjustable-discharge pump separately, and its procedures include:

A. When supplying cool air (as shown in FIG. 10A and FIG. 10B):

1. The revolving speed of the air generator:
   (1) When TA≧TAS+X, the air generator is operated at the highest revolving speed.
   (2) When TAS<TA<TAS+X, The revolving speed of the air generator is direct proportional to the TA value.
   (3) When TA≦TAS, the air generator is operated at the lowest revolving speed.
2. The discharge of the adjustable-discharge pump:
   (1) When ΔTW≧ΔTWS+Y (ΔTW=Tmo−Tmi, i.e., ΔTW is the difference between the coolant medium output temperature Tmo, and the coolant medium input temperature, Tmi; and Y is the set temperature difference), the adjustable-discharge pump discharges the maximum volume.
   (2) When ΔTWS<ΔTW<ΔTWS+Y, the volume of the adjustable-discharge pump is direct proportional to ΔTW.
   (3) When ΔTW≦ΔTWS, the adjustable-discharge pump discharges the minimum volume.

Figure 11A:
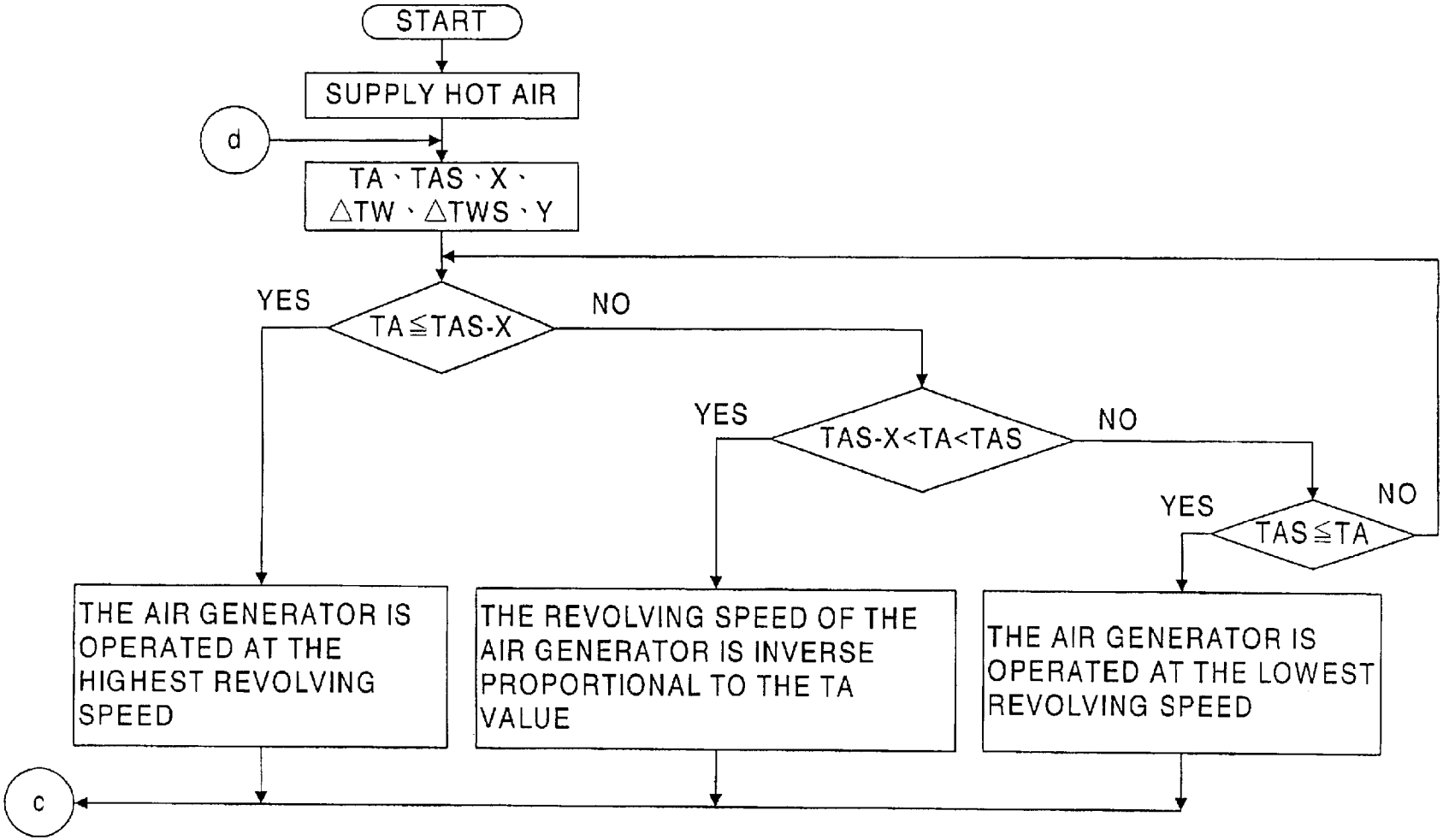
FIG. 11A and FIG. 11B are the second process flowchart of a preferred controlling method in use in accordance with the present invention.
Figure 11B:
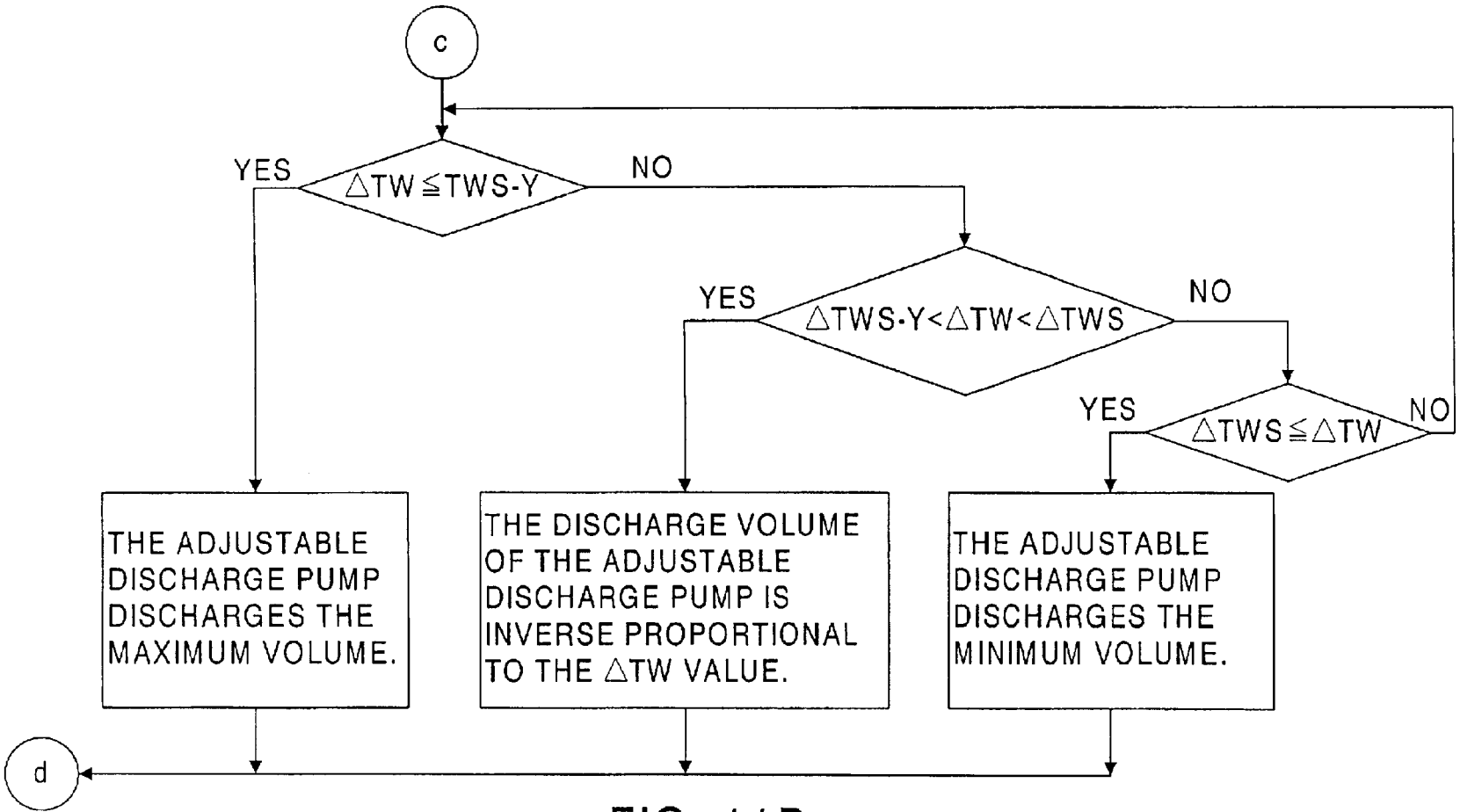

B. When supplying hot air (as shown in FIG. 11A and FIG. 11B):

1. The revolving speed of the air generator:
   (1) When TA≧TAS−X, the air generator is operated at the highest revolving speed.
   (2) When TAS−X<TA<TAS, The revolving speed of the air generator is inverse proportional to the TA value.
   (3) When TAS≦TA, the air generator is operated at the lowest revolving speed.
2. The discharge of the adjustable-discharge pump:
   (1) When ΔTW≦ΔTWS−Y, the adjustable-discharge pump discharges the highest volume.
   (2) When ΔTWS−Y<ΔTW<ΔTWS, the volume of the adjustable-discharge pump is inverse proportional to ΔTW.
   (3) When ΔTWS≦ΔTW, the adjustable-discharge pump discharges the lowest volume.

Summarized from the above, the present invention utilizes an adjustable-discharge pump to control the discharge of coolant medium, so it is able to adjust according to the variations of environmental heat energy value of the freezing and air-conditioning area and to increase the operation efficiency of the freezing and air-conditioning equipment and achieves the heat balance stability in the freezing and air-conditioning area. Furthermore, by saving the circulation volume of coolant medium, it achieves the energy saving objective.

While the present invention has been particularly shown and described with reference to a preferred embodiment, it will be understood by those skilled in the art that various changes in form and detail may be without departing from the spirit and scope of the present invention.

I claim:

1. A controlling method for the discharge of a coolant medium in a heat exchange wind box, comprising the steps of:

detecting an environmental heat energy value of a freezing and air-conditioning area and inputting said detected environmental heat energy value into a controller;

comparing said detected environmental heat energy value and a set heat energy value and corresponding signals generated by a set mode; and, simultaneously controlling a revolving speed of a fan motor and a discharge volume of an adjustable-discharge pump responsive to a result of said comparison, said step of simultaneously controlling including the steps of:

operating said revolving speed of said fan motor and said discharge volume of said adjustable-discharge pump at maximum values when supplying cool air and when said detected environmental heat energy value is larger than said set heat energy value plus a set difference;

operating said revolving speed of said fan motor and said discharge volume of said adjustable-discharge pump in direct proportion to said detected environmental heat energy value when supplying cool air and when said detected environmental heat energy value is larger than said set heat energy value but smaller than said set heat energy value plus said set difference;

operating said revolving speed of said fan motor and said discharge volume of said adjustable-discharge pump at minimum values when supplying cool air and when said detected environmental heat energy value is smaller than or equal to said set heat energy value;

operating said revolving speed of said fan motor and said discharge volume of said adjustable-discharge pump at maximum values when supplying hot air and when said detected environmental heat energy value is smaller than or equal to said set heat energy value minus said set difference; and operating said revolving speed of said fan motor and said discharge volume of said adjustable-discharge pump in inverse proportion to said detected environmental heat energy value when supplying hot air and when said detected environmental heat energy value is larger than said set heat energy value minus said set difference but smaller than said set heat energy value;

operating said revolving speed of said fan motor and said discharge volume of said adjustable-discharge pump at minimum values when supplying hot air and when said detected environmental heat energy value is larger than or equal to said set heat energy value.

2. A controlling method for the discharge of a coolant medium in a heat exchange wind box, comprising the steps of:

detecting an environmental heat energy value of a freezing and air-conditioning area and inputting said detected environmental heat energy value into a controller;

comparing said detected environmental heat energy value and a set heat energy value and corresponding signals generated by a set mode;

controlling a revolving speed of a fan motor responsive to a result of said comparison, said step of controlling a revolving speed of a fan motor including the steps of:

operating said revolving speed of said fan motor at a maximum value when supplying cool air and when said detected environmental heat energy value is larger than or equal to said set heat energy value plus a set difference;

operating said revolving speed of said fan motor in direct proportion to said detected environmental heat energy value when supplying cool air and when said detected environmental heat energy value is larger than said set heat energy value but smaller than said set heat energy value plus said set difference;

operating said revolving speed of said fan motor at a minimum value when supplying cool air and when said detected environmental heat energy value is smaller than or equal to said set heat energy value;

operating said revolving speed of said fan motor at a maximum value when supplying hot air and when said detected environmental heat energy value is smaller than or equal to said set heat energy value minus said set difference;

operating said revolving speed of said fan motor in inverse proportion to said detected environmental heat energy value when supplying hot air and when said detected environmental heat energy value is larger than said set heat energy value minus said set difference but smaller than said set heat energy value; and operating said revolving speed of said fan motor at a minimum value when supplying hot air and when said detected environmental heat energy value is larger than or equal to said set heat energy value; and, controlling a discharge volume of an adjustable-discharge pump responsive to a result of said comparison, said step of controlling a discharge volume of an adjustable-discharge pump including the steps of:

operating said discharge volume of said adjustable-discharge pump at a maximum value when supplying cool air and when a difference between a coolant medium output temperature and an input temperature is larger than or equal to a set difference plus a set temperature difference;

operating said discharge volume of said adjustable-discharge pump in direct proportion to said difference between said coolant medium output and input temperatures when supplying cool air and when said difference between said coolant medium output and input temperatures is larger than said set difference but smaller than said set difference plus said temperature difference;

operating said discharge volume of said adjustable-discharge pump at a minimum value when supplying cool air and when said difference between said coolant medium output and input temperatures is smaller than or equal to said set difference;

operating said discharge volume of said adjustable-discharge pump at a maximum value when supplying hot air and when said difference between said coolant medium output and input temperatures is smaller than or equal to said set difference minus said set temperature difference;

operating said discharge volume of said adjustable-discharge pump in inverse proportion to said difference between said coolant medium output and input temperatures when supplying hot air and when said difference between said coolant medium output and input temperatures is larger than said set difference minus said set temperature difference but smaller than said set difference; and operating said discharge volume of said adjustable-discharge pump at a minimum value when supplying hot air and when said difference between said coolant medium output and input temperatures is larger than or equal to said set difference.

* * * * *